United States Patent [19]

Lapeyre

[11] Patent Number: 4,509,617

[45] Date of Patent: Apr. 9, 1985

[54] STAIR HAVING ALTERNATE HALF TREADS

[75] Inventor: James M. Lapeyre, New Orleans, La.

[73] Assignee: The Laitram Corporation, New Orleans, La.

[21] Appl. No.: 402,219

[22] Filed: Jul. 26, 1982

Related U.S. Application Data

[63] Continuation-in-part of Ser. No. 257,960, Apr. 27, 1981, abandoned.

[51] Int. Cl.[3] ..... E06C 9/02; B63B 29/20

[52] U.S. Cl. ..... 182/93; 182/106; 182/194; 182/228

[58] Field of Search ..... 182/93, 90, 106, 94, 182/228, 189, 215, 107, 100, 194; 52/182, 187

[56] References Cited

U.S. PATENT DOCUMENTS

| | | | |
|---|---|---|---|
| 665,900 | 1/1901 | Hamilton | 182/228 |
| 1,415,699 | 5/1922 | Porter | 182/90 |
| 2,518,107 | 8/1950 | Wilson | 182/194 |
| 2,776,793 | 1/1957 | Nystrom | 182/93 |
| 3,762,500 | 10/1973 | Sarno | 182/93 |
| 4,199,040 | 4/1980 | Lapeyre | 182/93 |

FOREIGN PATENT DOCUMENTS

| | | | |
|---|---|---|---|
| 730678 | 5/1932 | France | 182/194 |

*Primary Examiner*—Reinaldo P. Machado
*Assistant Examiner*—Alvin Chin-Shue
*Attorney, Agent, or Firm*—Weingarten, Schurgin, Gagnebin & Hayes

[57] ABSTRACT

A stair having a central stringer and two parallel side stringers. A plurality of vertically-spaced half treads is disposed on each side of the central stringer and extends between the central stringer and an adjacent side stringer. The half treads on one side of the central stringer alternate with those on the other side of the central stringer. The central stringer may or may not be a structural member depending upon the stair configuration but in all cases serves at least as a protective shielding of the inside corners of the treads, thereby minimizing user injury from the corners in case of a fall or other user mishap. A pair of handrails are disposed in a plane forward and parallel to a plane passing through the front edges of the treads and positioned with respect to the treads to provide support for a user.

7 Claims, 27 Drawing Figures

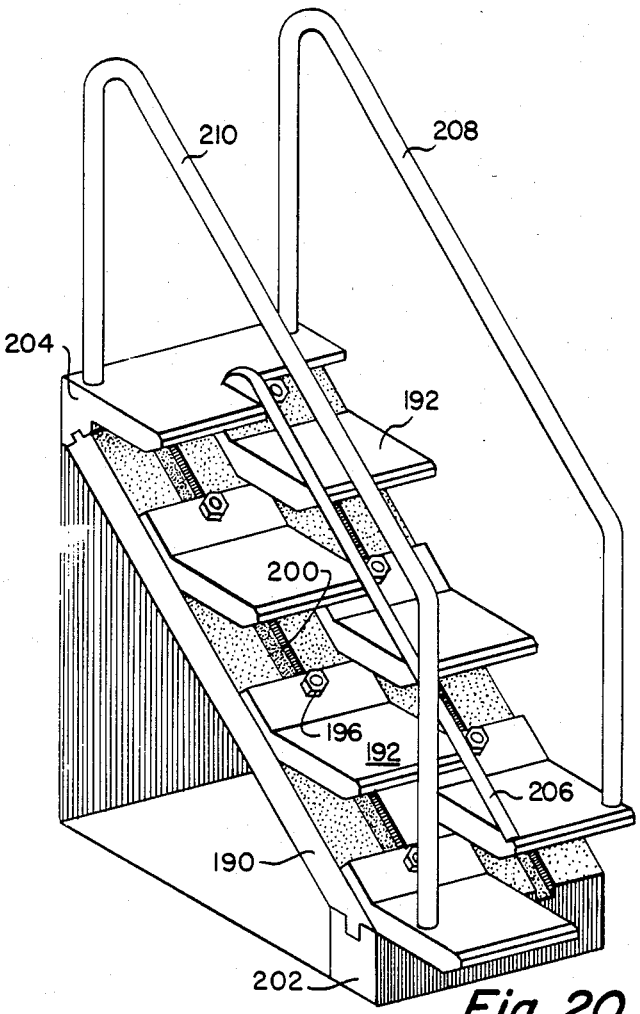
Fig. 20
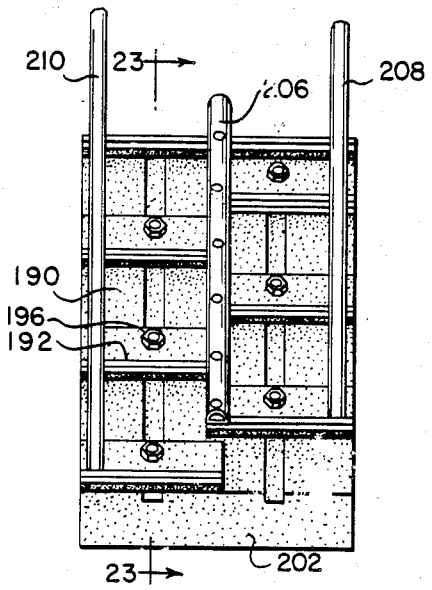
Fig. 21
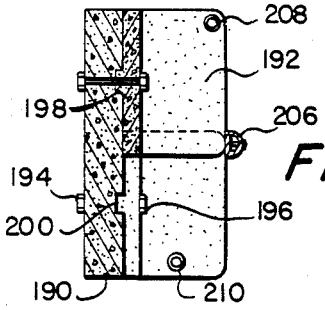
Fig. 24
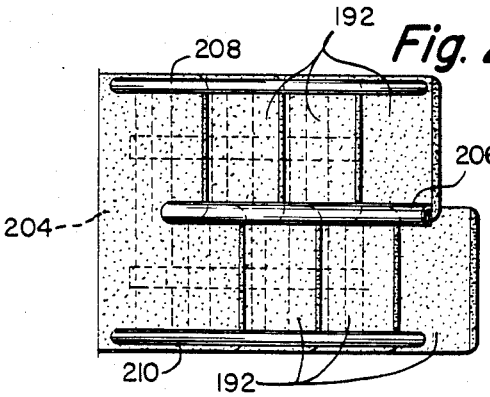
Fig. 22
Fig. 23
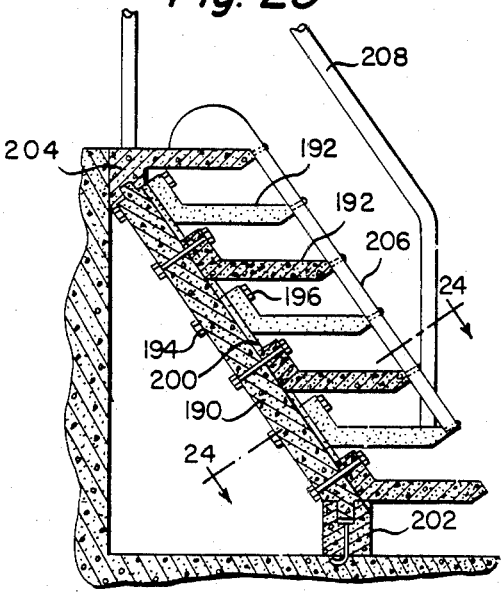

STAIR HAVING ALTERNATE HALF TREADS

RELATED APPLICATION

This application is a continuation-in-part of copending application Ser. No. 257,960, filed Apr. 27, 1981 now abandoned.

FIELD OF THE INVENTION

This invention relates to stairs and ladders, and more particularly to a stair having alternating half treads and which can be installed at relatively steep inclinations.

BACKGROUND OF THE INVENTION

A ladder is disclosed in U.S. Pat. No. 4,199,040, of the same inventor and assignee as this invention, which comprises a single stringer or central tread support disposed between upper and lower levels at a predetermined angle of inclination and having an array of half treads on each side of the stringer, each array being vertically spaced from the other along the length of the stringer. The half treads are affixed to and laterally extend from the respective sides of the stringer, and each includes an integral outwardly extending portion which terminates in a plane which is forward of a plane passing through the front edges of the treads. First and second handrails are disposed in this forward plane and are affixed to and supported by the outwardly extending tread portions. This novel ladder can be disposed at a relatively steep angle in comparison to a conventional ladder of the same tread width and riser height and provides sufficient safety and comfort to permit balanced use of the ladder, even without holding onto the handrails.

Ladders are known in which treads or rungs are alternately arranged along a single stringer or pole, as shown in U.S. Pat. Nos. 4,061,202 and 4,069,892. In ascending and descending ladders of this known type, a user must face the ladder and support himself by holding onto the rungs to guide his ascent or descent. Such ladders cannot be descended facing forwardly, as with a stairway, and these ladders require a fair degree of dexterity on the part of a user and are not very comfortable to use, and are sometimes unsafe.

In most stairways, the treads extend uniformly across the width of the stairway, each tread being of the same front-to-back dimension. The treads are supported by one or more stringers. Examples are shown in U.S. Pat. Nos. 3,310,132 and 3,467,220. Stairways are shown in U.S. Pat. Nos. 858,199 and 4,125,175 in which the treads are set back on alternate half portions to provide foot clearance in moving from the non-set-back portion of a tread to the next non-set-back portion of a succeeding tread, for the purpose of facilitating use of the stairway which is inclined at a relatively steep angle of inclination. In the structure of U.S. Pat. No. 858,199, each tread has a set-back portion and a non-set-back portion and is disposed between and supported by a pair of side stringers. In the structure of U.S. Pat. No. 4,125,175, the treads are similarly constructed and are each connected to an adjacent tread by a pair of vertical supports. Neither of these disclosed stairways employs any handrails.

SUMMARY OF THE INVENTION

The present invention relates generally to the type of stair shown in U.S. Pat. Nos. 4,199,040 and 4,316,524 of the same inventor and assignee. The invention comprises a stairway which has a central stringer and two parallel, spaced side stringers, a first array of half treads disposed between the central stringer and one side stringer and a second array of half treads disposed between the central stringer and the other side stringer. The treads of the first array are disposed intermediate the treads of the second array in an alternating pattern. A handrail is associated with each side stringer and is disposed in a plane forward and parallel to a plane passing through the front edges of the treads and positioned with respect to the treads to provide support for a user. The handrails are supported by balusters which extend upwardly from each side stringer. In alternative implementation, the treads are supported or are part of a unitary structure composed of, for example, concrete.

The handrails are spaced to be near the sides of a user's body and to comfortably guide the hands and body of a user ascending or descending the stairway. The handrails are of a height in relation to the treads to lie between the hips and arms of a user while descending the stairway. The relative positioning of the handrails in relation to each other and to the treads provides a stairway with a high degree of safety as well as user comfort. The forward surface of the central stringer is flush with or slightly outward of the front edges of the treads to serve as a rest or bumper for a user descending the stairway to provide additional user support. The handrail spacing for average size persons is typically 17–20 inches.

In ascending or descending the stair, the movement of a user's foot in proceeding to the next tread is unobstructed, since there is no half tread present between the two treads which are being used by the particular foot of the user. The stair can be disposed at a relatively steep angle in comparison to a conventional stair or ladder of the same tread width and riser height, and provides sufficient safety and comfort to permit balanced use without any special care or technique on the part of a user. While the embodiments illustrated are along a straight path, it is contemplated that the invention can also be embodied in stairs disposed along a curved path.

DESCRIPTION OF THE DRAWING

The invention will be more fully understood from the following detailed description taken in conjunction with the accompanying drawing, in which:

FIGS. 20, 21, and 22 are pictorial, front and top views respectively, of a further embodiment formed of concrete;

FIG. 23 is a sectional side elevation view of the embodiment of FIGS. 20–22; and FIG. 24 is a sectional view taken along lines 24—24 of FIG. 23.

DETAILED DESCRIPTION OF THE INVENTION

Figure 1:
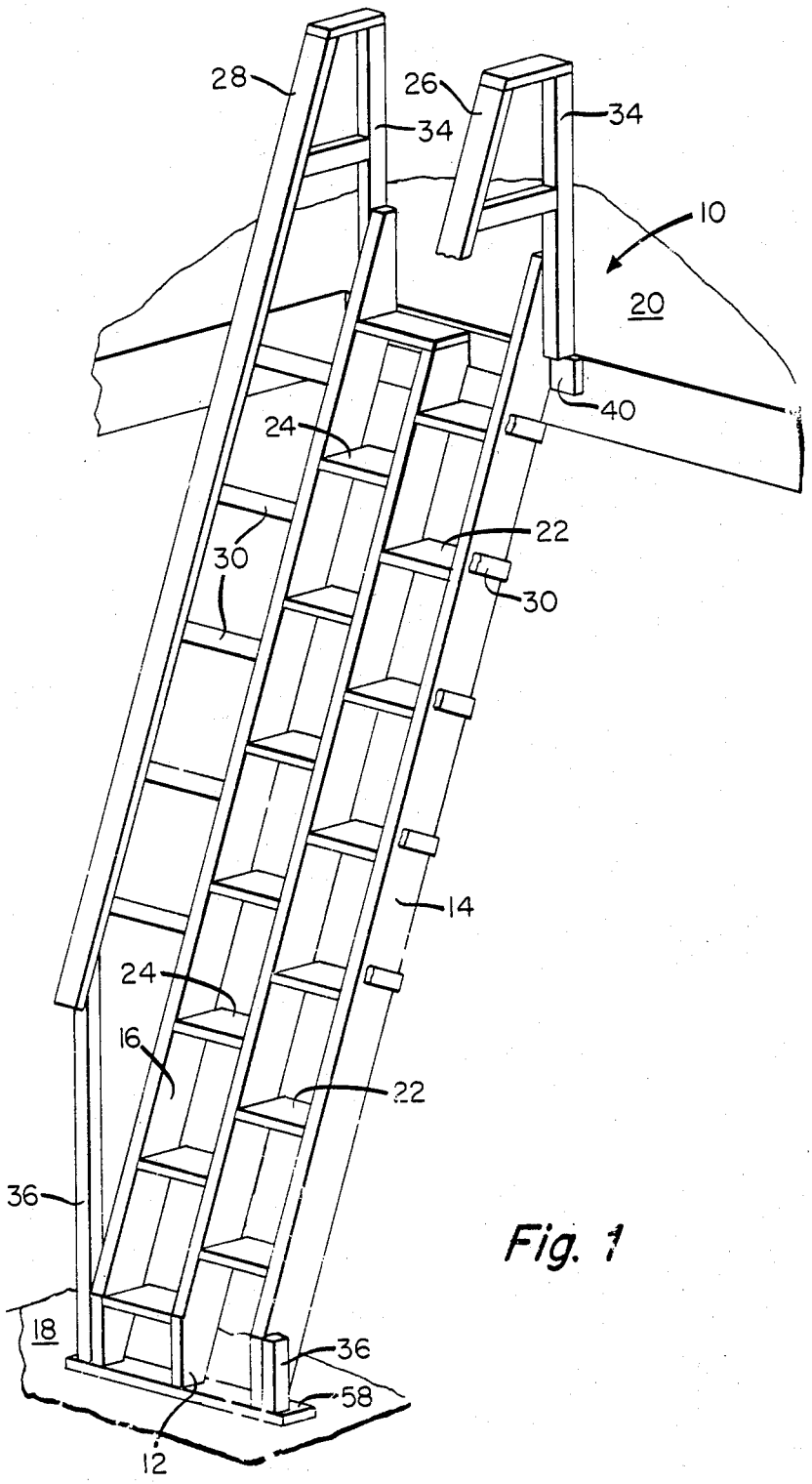
FIG. 1 is a perspective view of a preferred embodiment of the stairway of this invention made in wood.
Figure 2:
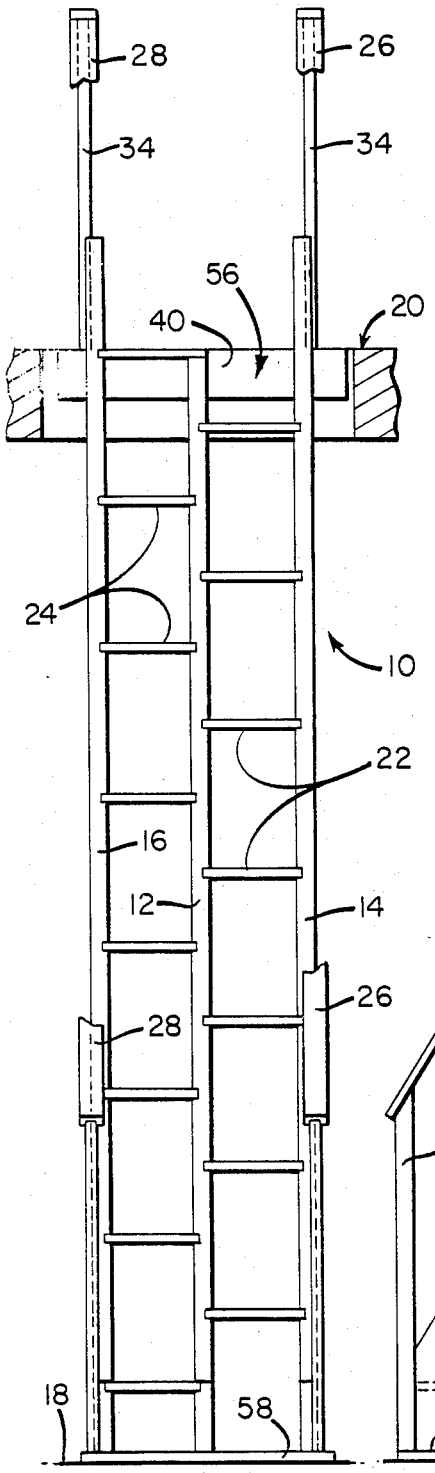
FIG. 2 is a front view of the stairway of FIG. 1.
Figure 3:
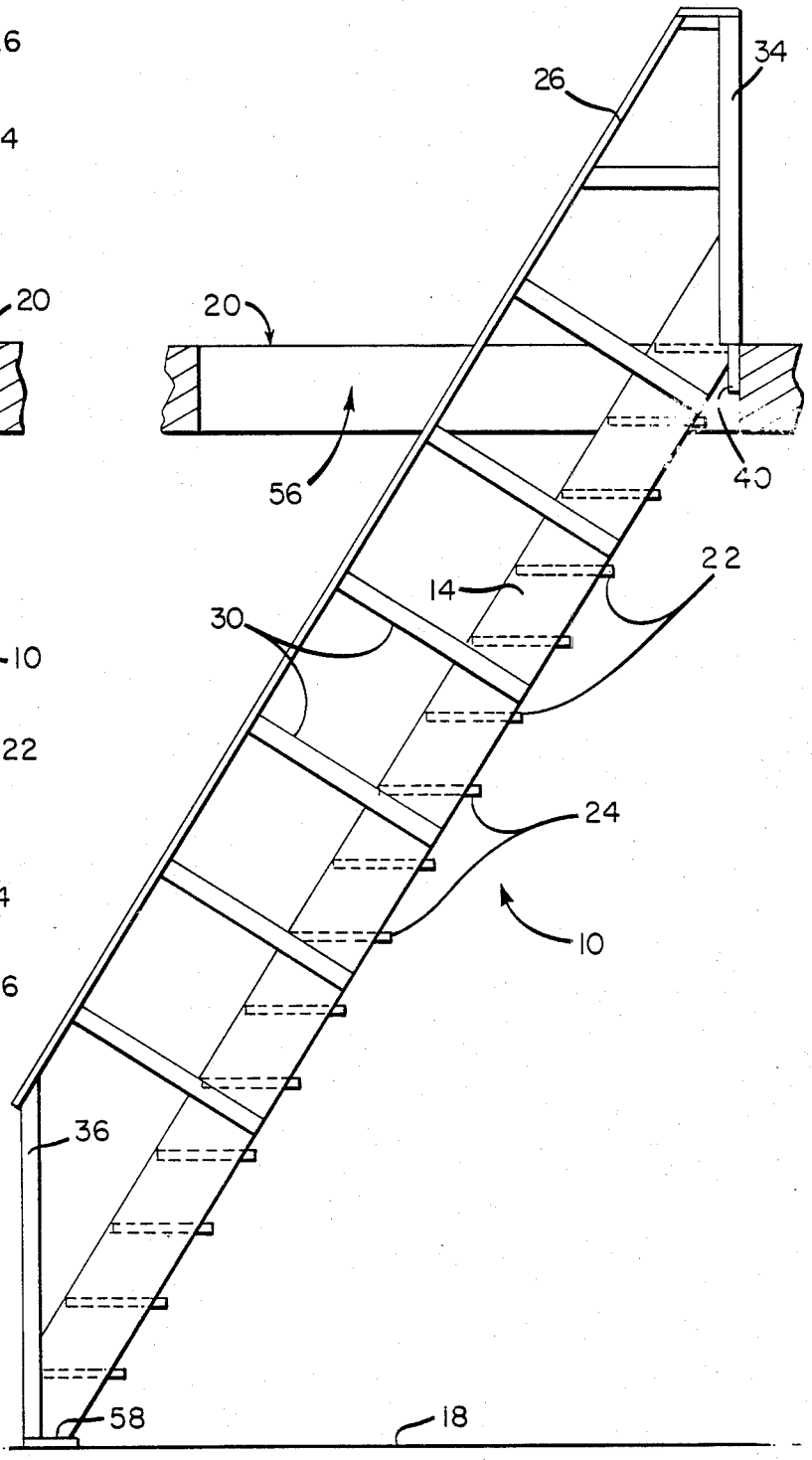
FIG. 3 is a side view of the stairway of FIG. 1.

With reference now to FIGS. 1 through 3, the stairway 10 of this invention includes a central tread support or stringer 12, and a pair of spaced, parallel side tread supports or stringers 14 and 16. Stringers 12, 14, and 16 typically extend between a lower surface 18 and an upper surface 20. Disposed on one side of central stringer 12 is an array of equally spaced half treads 22 which extend between side stringer 14 and central stringer 12. Disposed on the other side of central stringer 12 is another array of equally spaced half treads 24 which extend between central stringer 12 and side stringer 16. Each half tread 22 is disposed between two half treads 24 along central stringer 12 so that half treads 22 and half treads 24 form an alternating array. Each half tread 22 and 24 has a lateral extent and depth sufficient to accommodate and support one foot of a person using the ladder and normal outward angling of that foot.

Handrails 26 and 28 are disposed forwardly of the treads and in a plane forward and generally parallel to a plane passing through the front edges of the treads. The handrails 26 and 28 are supported by handrail supports or balusters 30, as shown in FIGS. 1–3, or by attachment to an adjacent wall (not shown), as where stairway 10 passes along a wall or between two walls. The balusters 30 are preferably secured to side stringers 14 and 16 and extend generally perpendicularly both to handrails 26 and 28 and their associated side stringers 14 and 16. The handrails 26 and 28 are positioned at a height in relation to the treads to provide support for a person using the stairway. The handrails are of a height to comfortably provide the user with underarm support. Preferably, the handrails are of a height to be under the arms of a user while descending the stair.

A base support plate 58 is disposed at the lower end of stringers 12, 14, and 16 and rests on lower surface 18. Extending upwardly from base support plate 58 in a generally vertical direction are a pair of lower handrail support arms 36, each arm 36 joining the lower end of a respective stringer 14 and 16 to the lower end of a respective handrail. Similarly, at upper surface 20, a pair of vertical upper handrail support arms 34 join the upper ends of respective side stringers 14 and 16 with the upper ends of the respective handrails. An upper support plate 40 is secured to stringers 12, 14, and 16 and is adapted to be affixed near upper surface 20.

Side stringers 14 and 16 and handrails 26 and 28 typically are spaced a distance sufficient to allow a person to comfortably ascend or descend stairway 10 while grasping the handrails. Stairway 10 can be ascended facing forwardly and can be readily descended facing outwardly from the ladder, as in descending a conventional stairway, rather than the rearward descent required for most rung-type ladders or steep stairways. The handrails are spaced to be slightly wider than the width of persons using the stairway such that the handrails confront the sides of a user's body to comfortably guide the hands and body of a user ascending or descending the stairway. The closeness of the handrails to the user should be sufficient to allow for normal slight side-to-side motion of the body when climbing or descending the stairway. Preferably, the handrails are of a height to lie between the hip and armpit of a user while descending the stairway. The forward edge of the central stringer is flush with or slightly outward of the front edges of the foot support portions and serves as a rest or bumper for a user descending the stairway. This forward edge of the central stringer can include a resilient strip for user comfort. As shown in FIG. 6A, a user may rest his buttocks on the stringer during descent of the stairway and may slide along the stringer during descent for secure use of the stairway, even under severe conditions, as on a rolling or pitching ship.

Figure 13:
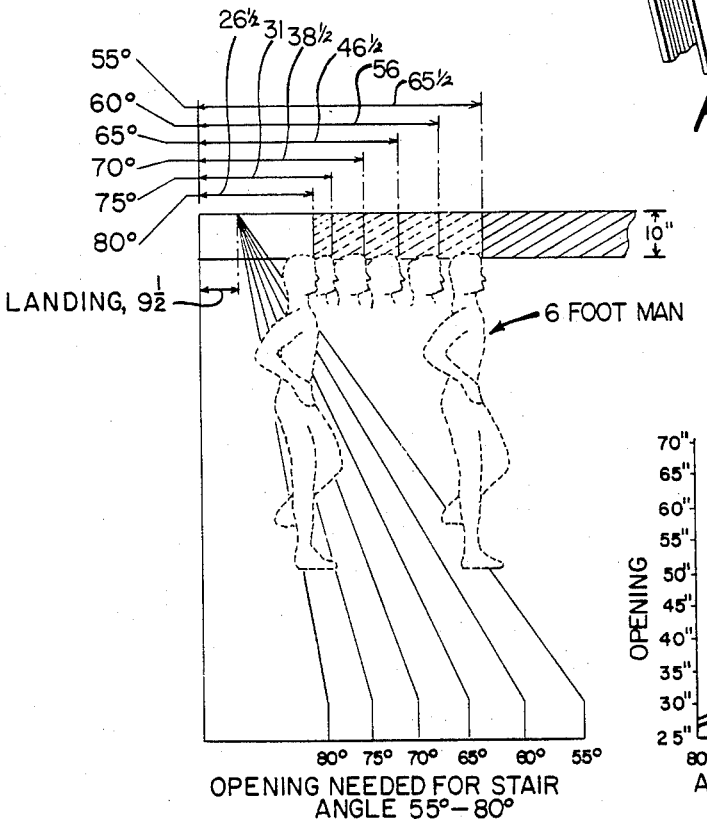
FIGS. 13 and 14 are graphs illustrating approximate head clearances for different stair angles.
Figure 14:
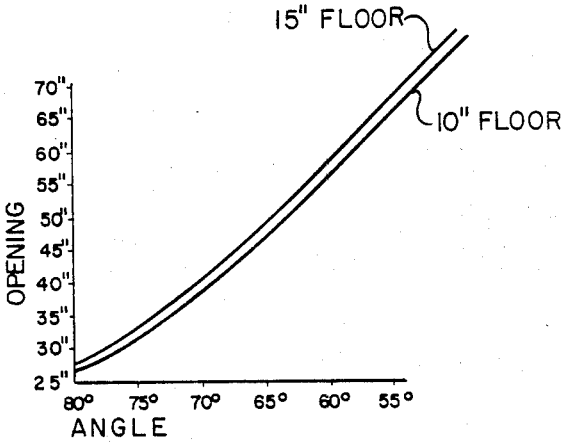

The stairway 10 may be deployed at any desired angle between upper surface 20 and lower surface 18, the exact angle depending upon the nature of the use desired, and the length of the stairway, although the angle is preferably greater than 50°. Typically, side stringers 14 and 16 and central stringer 12 form an angle of approximately 55°–80° with respect to lower surface 18. For a stairway which terminates at its upper end in an opening in the upper level, illustrated as opening 56 in FIGS. 2 and 3, the size of the opening will depend on the angle of the associated stairway. The relationship between approximate opening size and stair angle is illustrated in the graphs of FIGS. 13 and 14. FIG. 13 illustrates the approximate opening sizes for stair angles between 55° and 80°, and shows where a person's head would hit the upper surface while standing erect. The illustration of FIG. 13 is for an upper level or floor thickness of 10″. The head clearance also will vary in accordance with the thickness of the upper floor. The graph of FIG. 14 illustrates the opening sizes for corresponding stair angles, and for floor thicknesses of 10 inches and 15 inches, as examples. For greater floor thicknesses, greater opening size is needed to provide the necessary head clearance. Handrails 26 and 28 are typically spaced about two feet from the lower edge of side stringers 14 and 16 so that, for a stringer angle of 56° with respect to lower surface 18, a person would grasp handrails 26 and 28 about forty-four inches above the treads 22 and 24 upon which he is standing. Preferably, support plates 58 and 40 are secured to lower surface 18 and upper surface 20, respectively, to prevent movement of the stair during use. In FIGS. 1–3, an odd number of half treads 22 and 24 is preferably employed so that a person can ascend or descend the ladder always beginning with the same foot. To accommodate the usual range of adult sizes, the half treads 22 and 24 have a width typically of about 5 to 12 inches. The depth of treads 22 and 24 (from front to back) is typically 4 to 12 inches, and the riser height between adjacent treads typically can be 5 to 11 inches.

Figure 4:
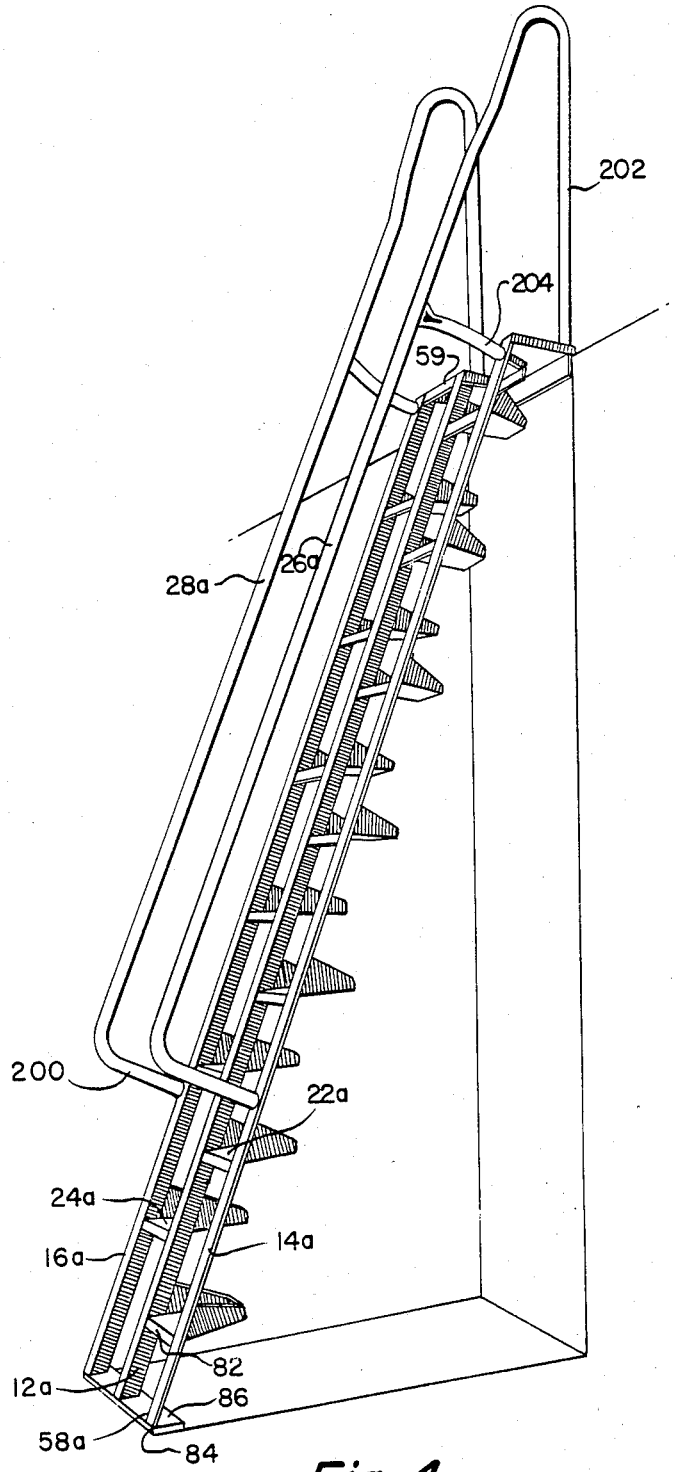
FIG. 4 is a pictorial view of an alternative embodiment of welded metal construction.
Figure 5:
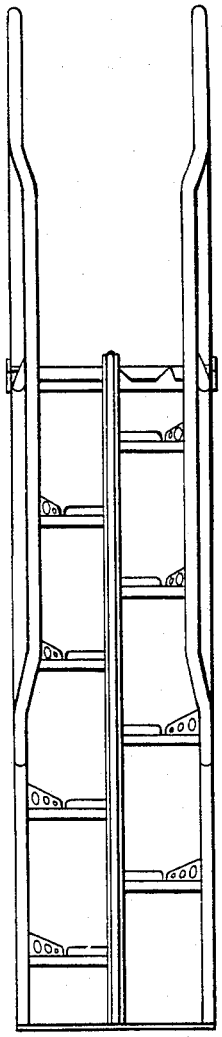
FIG. 5 is a front view of the stairway of FIG. 4.
Figure 6:
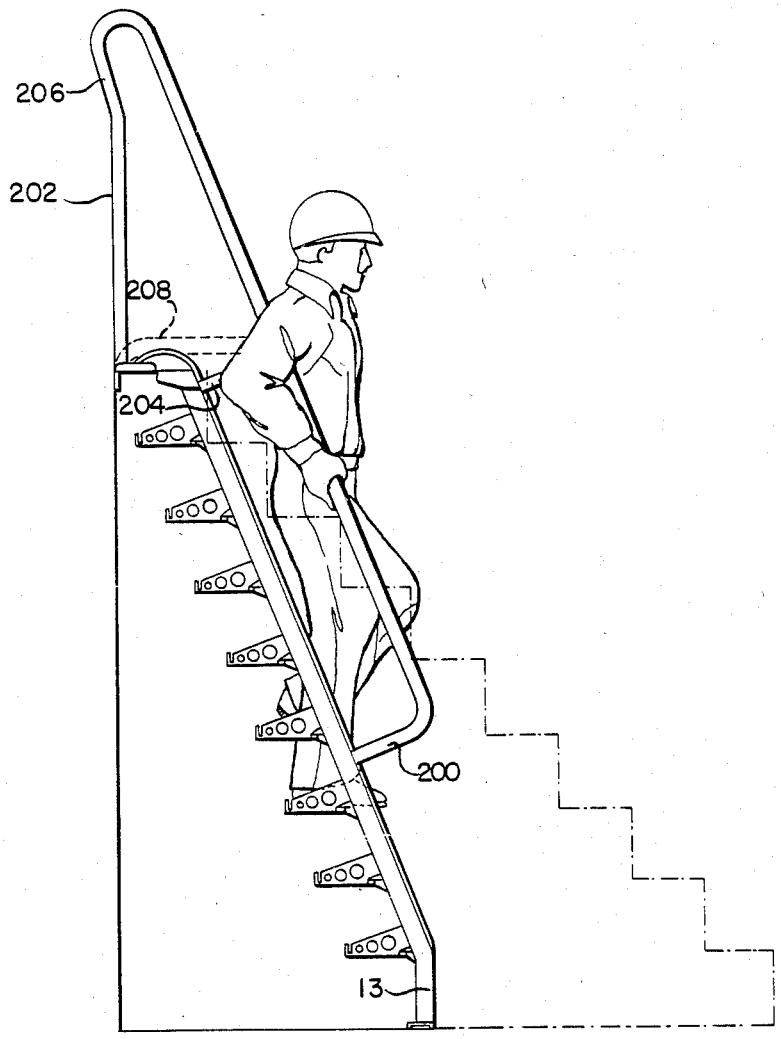
FIG. 6 is a side view of the stairway of FIG. 4 showing a user descending the stairway.
Figure 6A:
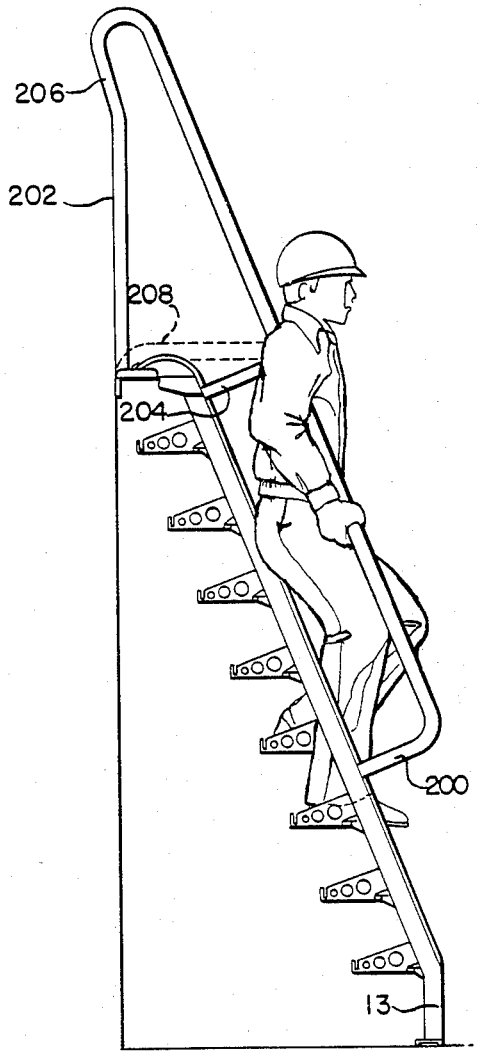
FIG. 6A is a side view of the stairway of FIG. 4 showing a user resting against the central stringer and with handrails behind the shoulders.
Figure 10:
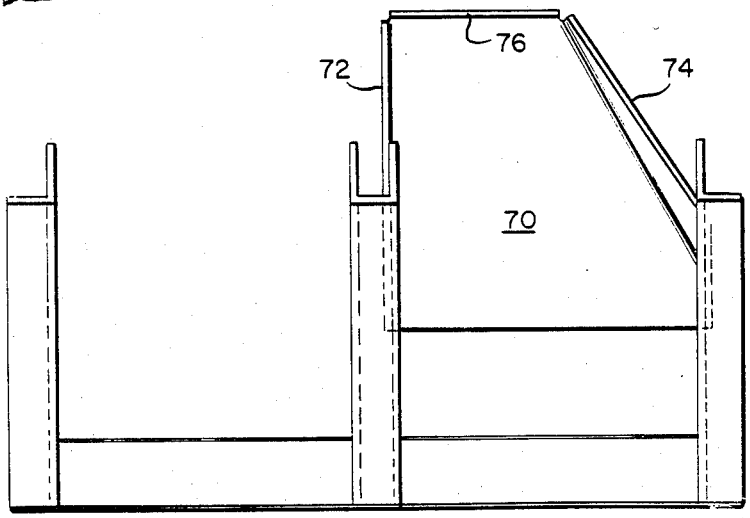
FIG. 10 is a top view of a tread member of the stairway of FIG. 4.
Figure 11:
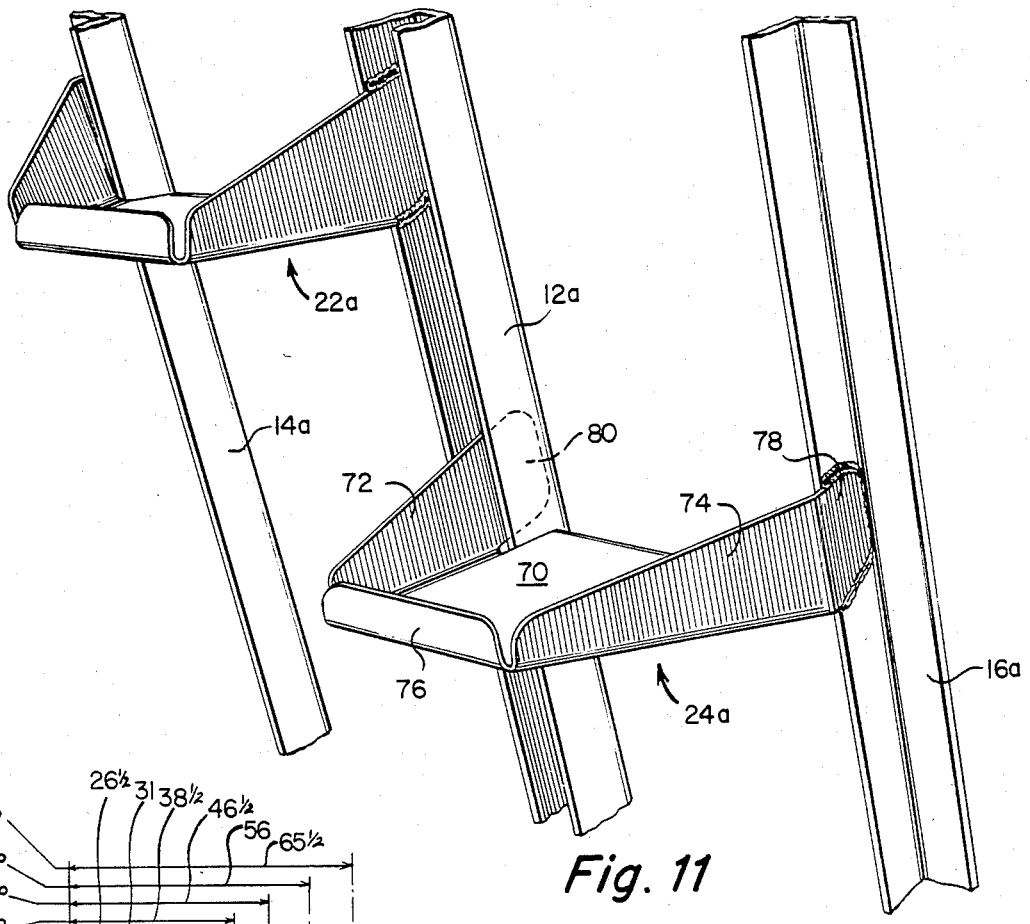
FIG. 11 is a pictorial view of a pair of spaced tread members attached to the respective supports of the stairway of FIG. 4.

An embodiment of the stairway is shown in FIGS. 4–6 and which is of welded steel construction. In the illustrated embodiment, the central stringer 12*a* and the outer side stringers 14*a* and 16*a* are identical steel channel members. Alternatively, the outer stringers can be angle members. The central stringer 12*a* has a knee at the lower end with a short vertical section 13 to minimize the space occupied by the stair. The stringers are welded to a bottom mounting plate 58*a* and to an upper mounting plate 59 which includes an upper half tread. The intermediate half treads 22*a* are of identical construction. The intermediate half treads 24*a* are also of identical construction to each other and are complementary to that of half treads 22*a*. The tread members are shown in FIGS. 10 and 11 and include a foot support portion 70 of generally trapezoidal outline, upwardly extending side flanges 72 and 74 and upwardly extending rear flange 76. The side flange 74 includes an end portion 78 adapted for welding to the side channel, while the other side flange 72 includes an end portion 80 adapted for welding to the central stringer. The tread member is formed of a single metal piece to provide a relatively inexpensive integral tread member which is easily attached and spot welded to the stringers. The tread also includes a downwardly extending front flange 82 (FIG. 4) which may be welded to the confronting stringers. The central and side stringers may all be identical standard structural shapes which are widely available and relatively inexpensive. Custom shapes can easily be formed as desired.

The bottom mounting plate 58*a* is of generally rectangular configuration having downwardly turned front and rear flanges 84 which rest on a mounting surface. Openings 86 are provided at the ends of the mounting plate and are disposed in the illustrated embodiment rearward of the side channels for acceptance of bolts or other fastening members for attachment of the mounting plate to the mounting surface.

Figure 12:
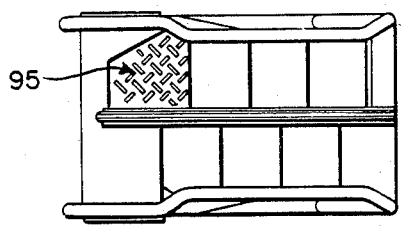
FIG. 12 is a top view of the stairway of FIG. 4 illustrating an alternative anti-skid pattern.
Figure 7:
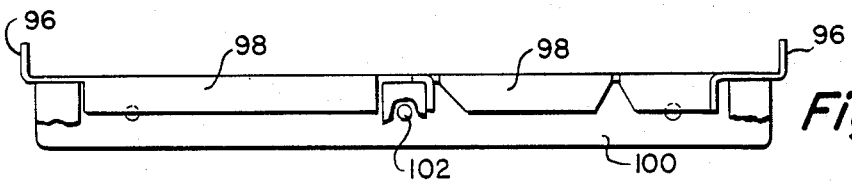
FIG. 7 is a front view of the upper support member of the stairway of FIG. 4.
Figure 8:
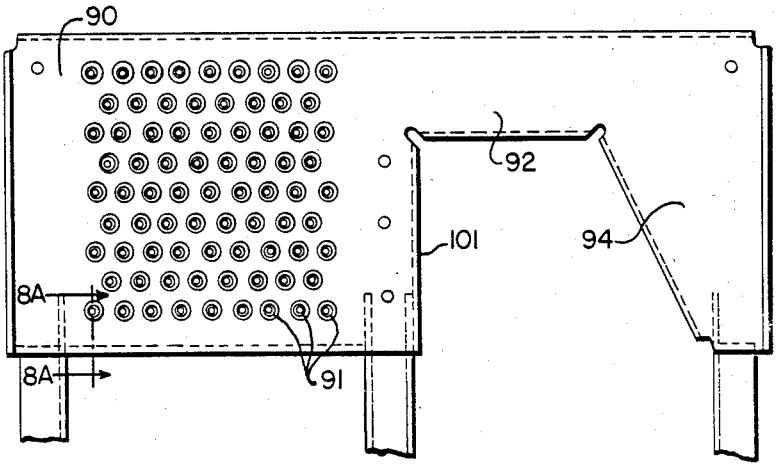
FIG. 8 is a top view of the upper support member of FIG. 7.
Figure 8A:
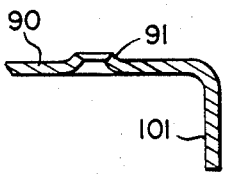
FIG. 8A is a sectional view illustrating the raised shoe grips of the support member.
Figure 9:
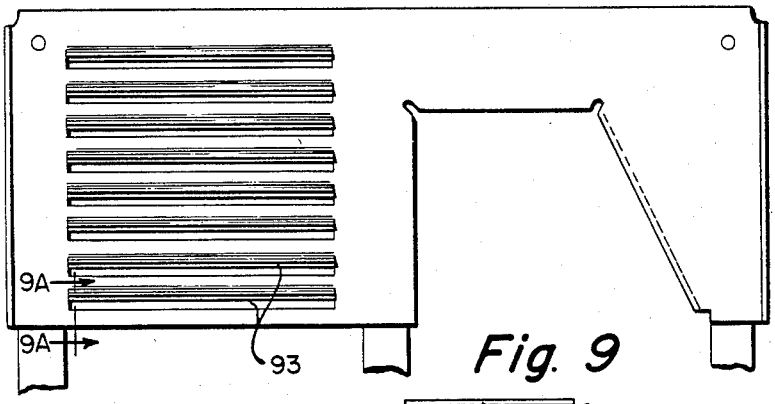
FIG. 9 is a top view of an alternative upper support member.
Figure 9A:
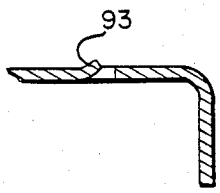
FIG. 9A is a sectional view illustrating the shoe gripping ribs of the support member of FIG. 9.

The upper member 59 is shown in FIGS. 7 and 8 and includes a generally rectangular foot support portion 90 on one side and joined by a narrower rectangular section 92 to a trapezoidal section 94 on the other side thereof. The upper member includes upwardly turned side flanges 96 and downwardly turned forward flanges 98, rearward flange 100, and side flange 101. The upper ends of the central and side stringers are welded to the upper member by way of the confronting flange portions as illustrated. The rear flange is employed for mounting of the upper end of the stairway to a mounting member such as by bolts or other fastening members 102 fastened through openings provided in the rear flange. The upper tread member is affixed flush with the upper level with which the stairway is employed. The foot support portion 90 includes an array of raised dimples 91, one being illustrated more particularly in FIG. 8A, which provide gripping or anti-skid surfaces for a user's foot. Alternative gripping surfaces can be provided by raised ridges 93, as shown in FIGS. 9 and 9A, which can be formed by slitting and raising spaced portions of the foot support area. A cross hatched pattern of anti-skid ridges 95 is shown in FIG. 12.

The stairway can be readily fabricated to intended lengths with only a small number of modular components; namely, the tread members, the upper tread member and lower support plate, and central and side stringers.

The handrails 26*a* and 28*a* are substantially straight along most of their length and outwardly flair at the lower end to provide wider spacing for hip clearance of a user in entering and exiting the stairway. Each handrail includes a lower end 200 which is bent to be joined to the respective side stringer. The upper end of the handrails are also bent outwardly to provide a wider spacing for hip clearance in entering and exiting the stairway. The upper end of each handrail includes a vertical section 202 which is joined to the upper tread member as illustrated. In the embodiment shown, a back bend 206 is provided at the upper end of the handrails to minimize the space occupied by the stair. Support members 204 can be provided between the upper end of the side stringers and the respective handrails for additional support of the rails. The handrails and supports are formed of steel tubing which can be easily cut and formed to the desired configuration and length. An alternate handrail termination at the upper end is illustrated by dotted outline 208 in FIGS. 6 and 6A in which the upper end of the rails extend horizontally in approximate line with the upper tread.

Figure 15:
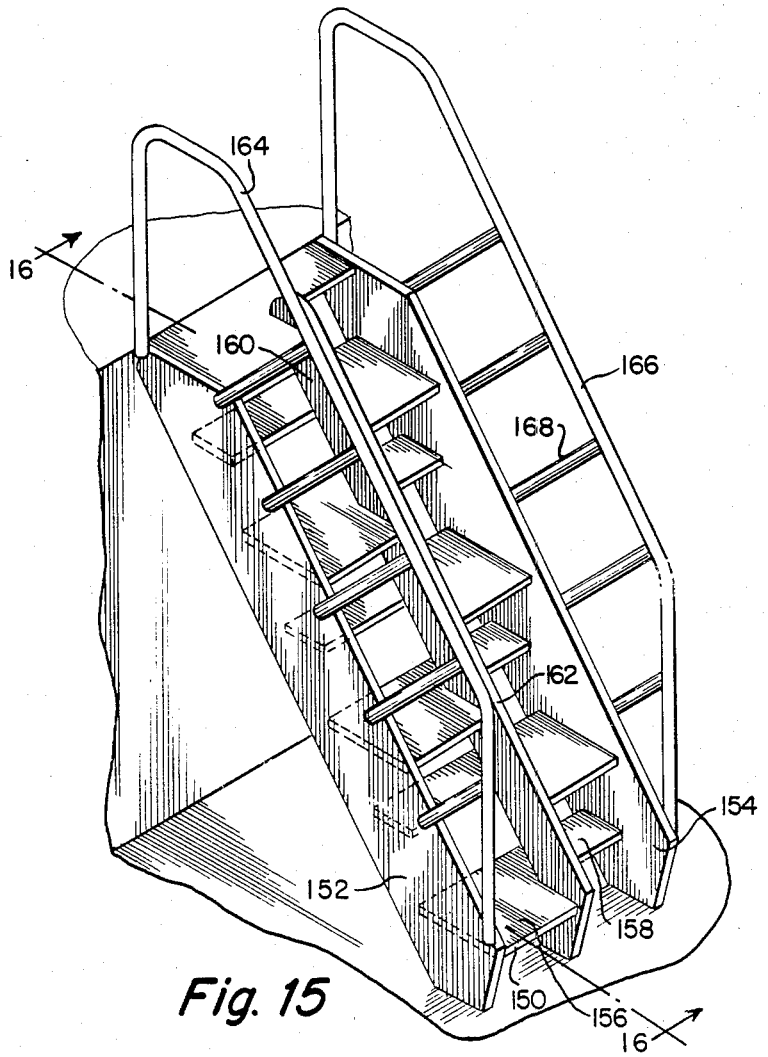
FIG. 15 is a pictorial view of a further embodiment.
Figure 16:
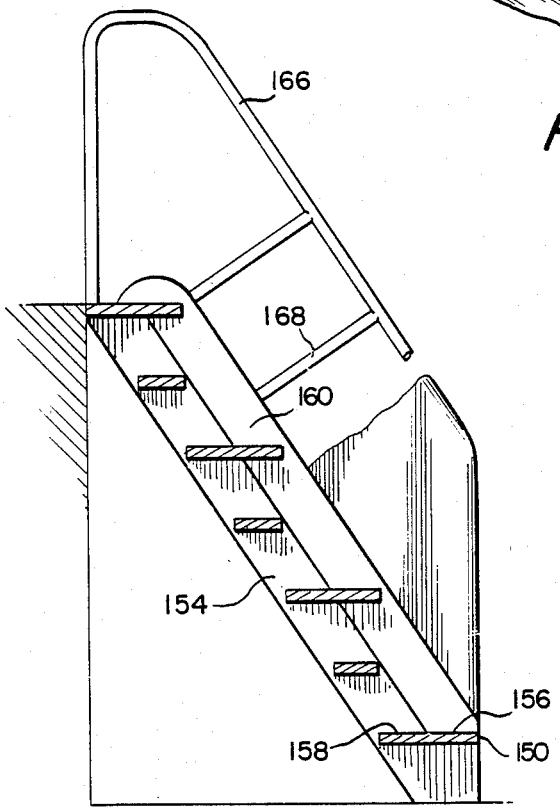
FIG. 16 is a side elevation view of the embodiment of FIG. 15.

A further embodiment of the stairway is shown in FIGS. 15 and 16 and wherein the treads 150 are supported by side stringers 152 and 154. Each tread 150 includes a foot support portion 156 attached to one side stringer, and a narrower portion 158 attached to the other side stringer. The treads are of alternating configuration such that the foot support portions are in alternating arrangement, as in the embodiments described above. The narrower portion 158 of each tread is integral with the foot support portion 156 of that tread. A central member 160 is disposed along the length of the stairway and is attached to the inner sides of the foot support portions 156 of the treads. The central member 160 has an outer edge 162 which is flush with or outwardly extending from the forward edges of the foot support portions 156. In this embodiment, the central member 160 need not provide structural support of the tread members. The forward edge 162 of member 160 shields the inner corners of the foot support portions 156 of the treads to prevent slippage or catching of a user's foot. The member 160 also provides a rest against which a user can lean in descending the stairway face forward. Handrails 164 and 166 are provided as illustrated and are attached to the respective side stringers, these handrails being of a height and spacing to provide support to a user's body, as described above. Handrail supports 168 can be provided to additionally strengthen the handrails. A user can rest his foot on the narrower portion 158 if the user stops on a climb up the stairway.

The novel stairway can also be employed along a wall with side support provided by the wall and one handrail. Such an embodiment can be similar to the embodiments described herein, except that the stairway is disposed along a wall and contains a single handrail on the outer side of the stairway.

Figure 17:
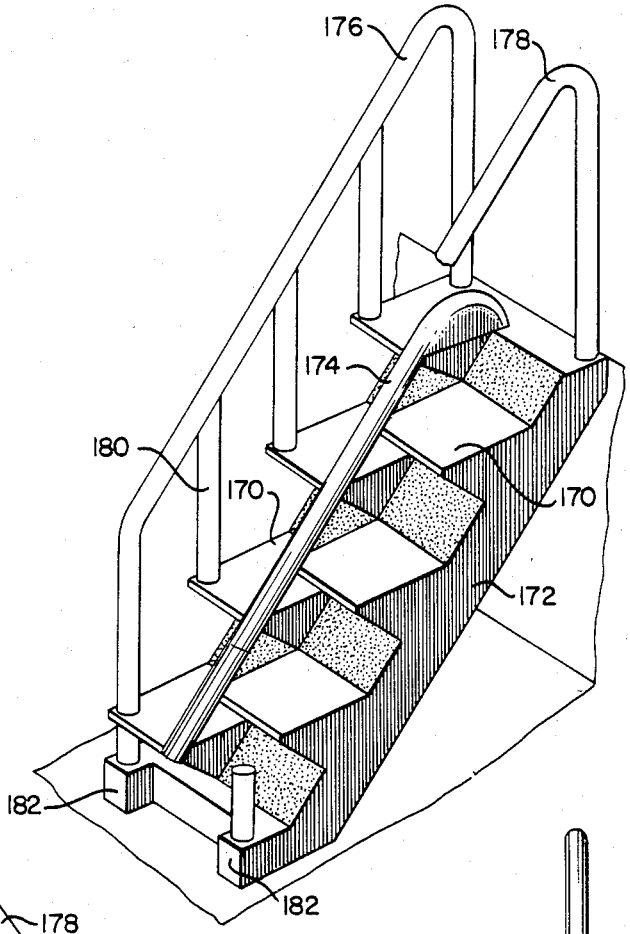
FIGS. 17, 18, and 19 are pictorial, sectional side elevation and front views respectively, of an embodiment of cast concrete construction.
Figure 18:
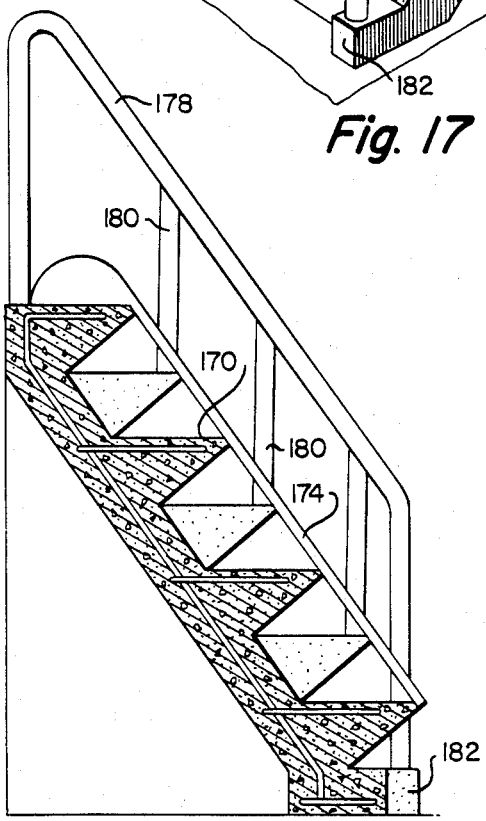
Figure 19:
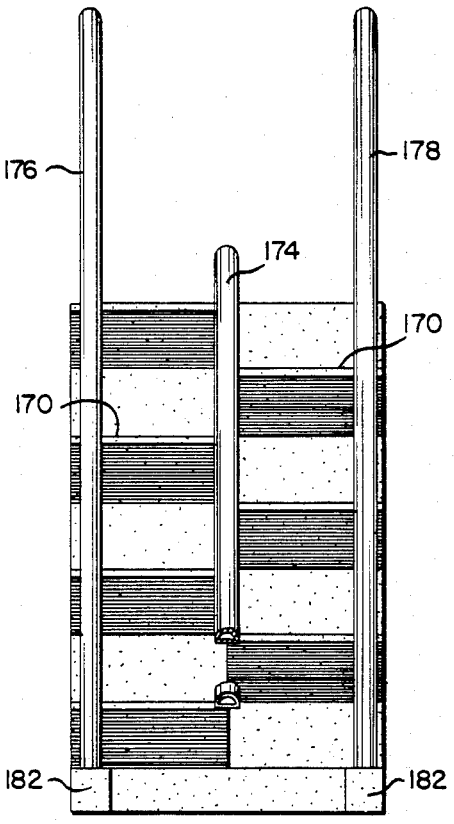

An additional embodiment is shown in FIGS. 17–19 in which the treads 170 are supported by and integral with a unitary support structure 172 which is formed of reinforced concrete or terrazzo. The stairway of this embodiment can be cast as a single unitary structure to form a stairway of intended size. A central member 174 is disposed along the inner corners of the tread members and provides a shield or guard for the inner corners to prevent the foot of a user from catching or slipping on the corners. The central member 1 also acts to prevent injury to the user's tail bone in case of a fall. The central member 174 also serves as a guide for each foot of a user in ascending or descending the ladder by keeping each foot on the respective sides of the stairway. The central member can also serve as a rest against which a user can lean in descending the stairway face forward. The handrails 176 and 178 are, as in the embodiments described above, of a height and spacing to provide support to a user's body. Handrail supports 180 or balusters can be provided as required to strengthen the handrails. The base of the cast structure may include portions 182 which provide pedestals to which the lower ends of the handrails may be attached.

A further embodiment constructed of concrete is shown in FIGS. 20–24. Here, a concrete slab 190 has concrete tread members 192 fastened to the slab 190 by bolts 194 and nuts 196. The bolts are preferably cast into the concrete slab 190 at the intended positions to secure the tread members 192 in the alternating tread configuration. The tread members 192 included a tongue 198 which fits within the groove 200 provided on each side of the slabs 190. The slab 190 is secured to a base 202 and to an upper platform 204. A central member 206 is disposed along the inner corners of the tread members 192 to serve as a shield or guard for the inner corners as described above. A pair of handrails 208 and 210 is provided in the same manner and described above.

The stairway of this invention is safe and comfortable to use and is of a construction which is relatively simple and inexpensive. This stairway employs less floor space and overhead space to accommodate its horizontal run, since it is more steeply inclined than a conventional stairway while providing equivalent riser-tread relationships and therefore the same degree of comfort and safety.

The invention is not to be limited except as indicated in the appended claims.

What is claimed is:

1. A stairway comprising:

first and second spaced, parallel side tread supports adapted for mounting between an upper level and a lower level at a predetermined angle of inclination;

a central tread support having an outer edge, said central support disposed between said side supports and parallel thereto;

a plurality of first spaced tread members extending laterally between the first side tread support and said central tread support, each of said first tread members having a foot support portion;

a plurality of second spaced tread members extending laterally between said central tread support and the second side tread support, each of said second tread members being disposed between adjacent ones of said first tread members in an alternating relationship therewith, each of said second tread members having a foot support portion;

each of said foot portions on the first and second tread members having a forward edge, a lateral inner edge, a lateral outer edge and a rear edge;

first and second handrails each supported on a respective side of the tread members and disposed in a plane forward and parallel to a plane passing through the forward edges of the foot support portions, the handrails positioned at a height in relation to the foot support portions to lie under the armpits and support the forearms of a user while descending the stairway;

said first tread members being of substantially identical construction, the first tread members being complimentary to the second tread members;

said tread members integrally formed as a single unitary structure, each tread member including:

an upwardly extending flange at the inner and outer lateral edges and the rear edge of the foot support portion, and having mounting portions for attaching the tread member to respective side and central tread support members; and a downwardly extending flange at the forward edge of the foot support portion, said downwardly extending flange having side portions for attaching the tread member to respective side and central supports;

said first and second tread supports comprising first and second right angle members with an inner angle surface and an outer surface, said central tread support comprising a U-shaped member having an inner surface and an outer surface;

said mounting portions of the upwardly extending flanges of the first and second tread members adapted to confront the inner angle surface of the respective first and second right angle members and the inner surface of the U-shaped member.

2. The stairway of claim 1 wherein the side portions of the downwardly extending flanges of said first and second tread members confront the outer surface of the respective first and second right angle members and the outer surface of said U-shaped member.

3. The stairway of claim 1 wherein the right angle members and the U-shaped member are standard metal sections.

4. A stairway comprising:

first and second spaced, parallel side tread supports adapted for mounting between an upper level and a lower level at a predetermined angle of inclination;

a central tread support having an outer edge, said central tread support disposed between said side tread supports and parallel thereto;

a plurality of first spaced tread members extending laterally between the first side tread support and said central tread support, each of said first tread members having a foot support portion;

a plurality of second spaced tread members extending laterally between said central tread support and the second side tread support, each of said second tread members being disposed between adjacent ones of said first tread members in an alternating relationship therewith, each of second tread members having a foot support portion;

each of said foot support portions of the first and second tread members having a forward edge, a lateral inner edge, a lateral outer edge, and a rear edge;

said first and second tread supports comprising first and second right angle members with an inner angle surface and an outer angle surface, said central tread support member comprising a U-shaped member having an inner surface and an outer surface;

at least one of said tread members including an upwardly extending flange at the lateral inner edge of the foot support portion, each of said flanges including a mounting portion for attaching the tread member to respective side and central tread support members;

said mounting portions of the upwardly extending flanges of the first and second tread members adapted to confront one of said surfaces of the respective first and second right angle members and one of said surfaces of said U-shaped member.

5. The stairway of claim 4 wherein at least some of said tread members include a downwardly extending flange at the forward edge of the foot support portion having side portions for attaching the tread member to respective side and central tread supports.

6. The stairway of claim 4 further including a resilient strip disposed on the outer edge of the central tread support as a rest for a user while descending the stairway.

7. The stairway of claim 4 wherein said stairway is an integral unitary metal structure of welded construction.

* * * * *